US007665824B2

(12) United States Patent
Riou et al.

(10) Patent No.: US 7,665,824 B2
(45) Date of Patent: Feb. 23, 2010

(54) PRINTING SYSTEM CONDENSER

(75) Inventors: Michel A. Riou, Calgary (CA); David B. Larson, Eagle, ID (US); Martin G. Rockwell, Sherwood, OR (US); David R. Christmann, Boring, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1120 days.

(21) Appl. No.: 10/698,511

(22) Filed: Oct. 31, 2003

(65) Prior Publication Data

US 2005/0093908 A1 May 5, 2005

(51) Int. Cl.
*B41J 2/165* (2006.01)

(52) U.S. Cl. ..... 347/34; 347/36

(58) Field of Classification Search ..... 347/34
See application file for complete search history.

(56) References Cited

U.S. PATENT DOCUMENTS 3,848,988 A * 11/1974 Thettu et al. ..... 399/97
3,854,224 A * 12/1974 Yamaji et al. ..... 34/77
4,004,513 A * 1/1977 Watanabe et al. ..... 101/489
4,524,365 A * 6/1985 Kakeno et al. ..... 347/86
4,556,487 A * 12/1985 Ueda ..... 210/267
4,914,453 A * 4/1990 Kanayama et al. ..... 347/86
4,919,301 A * 4/1990 Miller ..... 137/581
4,958,681 A * 9/1990 Kadle ..... 165/151
5,073,796 A * 12/1991 Suzuki et al. ..... 399/93
5,280,709 A * 1/1994 Wang ..... 62/617
5,335,000 A 8/1994 Stevens
5,446,487 A * 8/1995 Russell et al. ..... 347/102
5,532,720 A * 7/1996 Krueger et al. ..... 347/85
5,771,053 A * 6/1998 Merrill ..... 347/86
6,025,860 A * 2/2000 Rosenfeld et al. ..... 347/171
6,076,913 A * 6/2000 Garcia et al. ..... 347/19
6,085,055 A * 7/2000 Shin et al. ..... 399/250
6,088,560 A * 7/2000 Zenk et al. ..... 399/237
6,101,356 A * 8/2000 Kim et al. ..... 399/250
6,174,055 B1 * 1/2001 Sugikubo et al. ..... 347/89
6,176,563 B1 * 1/2001 Anderson et al. ..... 347/22
6,203,138 B1 * 3/2001 Hirabayashi et al. ..... 347/36
6,281,911 B1 * 8/2001 Nakazawa et al. ..... 347/86
6,352,324 B1 * 3/2002 Pagnon et al. ..... 347/6
6,357,854 B1 * 3/2002 Igval et al. ..... 347/36
6,397,488 B1 * 6/2002 Brinkly ..... 34/92
6,512,900 B2 * 1/2003 Sakai ..... 399/93
6,536,863 B1 * 3/2003 Beauchamp et al. ..... 347/17
6,553,689 B2 * 4/2003 Jain et al. ..... 34/444
6,659,587 B2 * 12/2003 Berg et al. ..... 347/36
6,771,916 B2 * 8/2004 Hoffman et al. ..... 399/92
6,854,843 B2 * 2/2005 Anami et al. ..... 347/104
6,874,877 B2 * 4/2005 Gaston et al. ..... 347/86
6,908,179 B2 * 6/2005 Pan et al. ..... 347/86

(Continued)

FOREIGN PATENT DOCUMENTS

EP 0816097 7/1998

(Continued)

*Primary Examiner*—Matthew Luu
*Assistant Examiner*—Shelby Fidler

(57) ABSTRACT

A printing system includes an ink dispenser configured to dispense ink upon a print medium, a condenser configured to condense vapor into a condensate and a receptacle configured to collect the condensate. The receptacle is perforated to permit a portion of the condensate to evaporate.

37 Claims, 2 Drawing Sheets

U.S. PATENT DOCUMENTS

| | | | |
|---|---|---|---|
| 2001/0017997 | A1 | 6/2001 | Saitoh |
| 2001/0002952 | A1 | 7/2001 | Sakai |
| 2003/0179260 | A1 | 9/2003 | Anderson et al. |

FOREIGN PATENT DOCUMENTS

| | | | |
|---|---|---|---|
| EP | 1 308 300 | 7/2003 | |
| FR | 2618727 | 3/1989 | |
| FR | 2709092 | 2/1995 | |
| GB | 2010104 | 6/1979 | |
| JP | 02026751 | 1/1990 | |
| JP | 06226991 | 8/1996 | |
| JP | 08216428 | 8/1996 | |
| JP | 11014258 | 1/1999 | |
| WO | WO 93/17869 | 9/1993 | ..... 347/7 |

* cited by examiner 10
80
13
20
22
52
56
76
76
58
50
78
70
72
26
46
16
30
54
12
32
74
46
40
104
14
18
36
36
12
60
66
96
94
96
94
82
28
38
66
34
103
110
64
62
100
104
24
92
106
90
88
85
86
90
102
84
112

157
161
163
72
154
167
167
167
50
26
159
165
104
74
60

FIG. 3
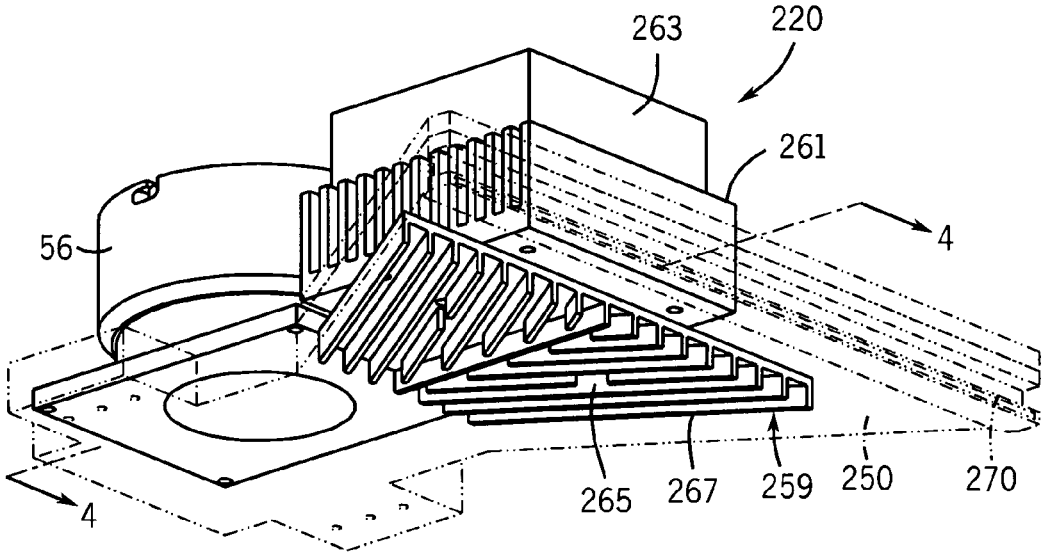
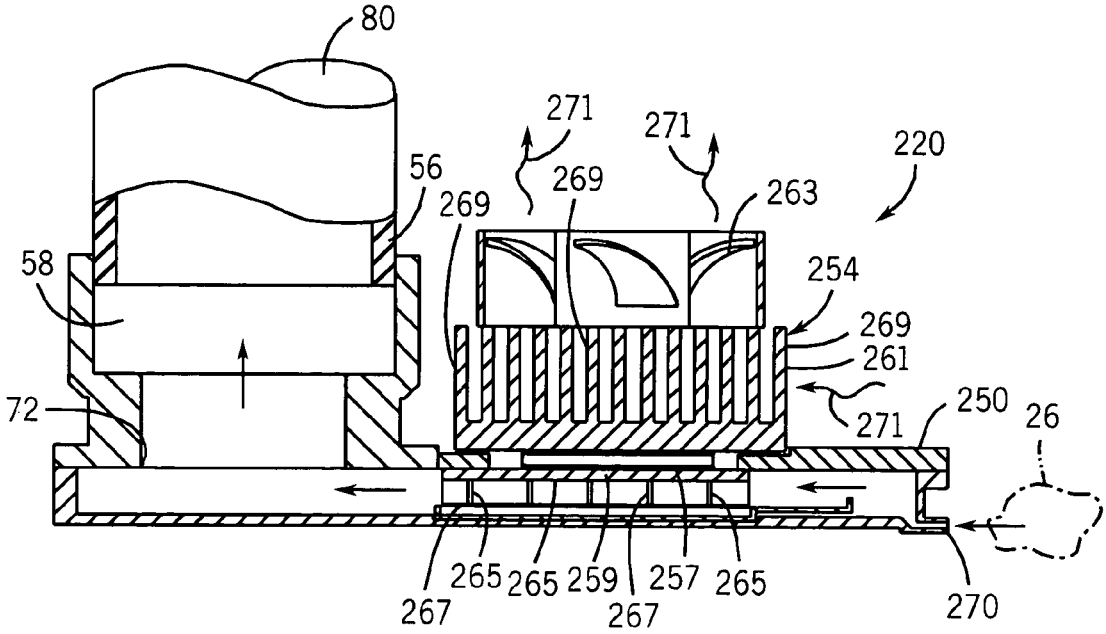
FIG. 4

PRINTING SYSTEM CONDENSER

CROSS-REFERENCE TO RELATED PATENT APPLICATIONS

The present application is related to U.S. Pat. No. 6,874,877 filed on Oct. 30, 2002 by Gonzalo Gaston, Antonio Monclus and Lluis Valles and entitled "Ink Condensate Removal in Hardcopy Apparatus," the full disclosure of which is hereby incorporated by reference.

BACKGROUND

The ink used in inkjet printers typically comprises 20% by volume of pigment or dye with traces of various additives, some of which are volatile. The balance, i.e., substantially 80%, is water. When a swath of such ink is deposited on a print media, it requires a drying time before the next swath is printed to avoid bleeding problems between the swaths. An end of plot drying time is also required to avoid ink becoming smeared during transfer of the print media to the next stage.

To allow the ink to dry naturally takes a relatively long time, which has an adverse effect on throughput, so inkjet printers and other hardcopy apparatus which are in heavy use are provided with active drying systems, which eliminate moisture content from the printed surface as quickly as possible. Typically the active drying system comprises a fan and ducting system to flow air over the ink in the print zone, and/or a heater arranged under the printing platen to evaporate the moisture.

Since the vapor created by the drying system is predominantly water, the atmosphere in a room containing a hardcopy apparatus in heavy use can become unacceptably humid, with condensation forming on windows and walls. A large ink-jet printer can produce approximately 1 liter of water per hour.

BRIEF DESCRIPTION OF THE DRAWINGS

FIG. 3 is a bottom perspective view of an alternative embodiment of the vapor handling system of FIG. 2, portions shown in phantom for ease of illustration.

FIG. 4 is a sectional view of the vapor handling system of FIG. 3 taken along line 4-4.

DETAILED DESCRIPTION OF EXAMPLE EMBODIMENTS

Figure 1:
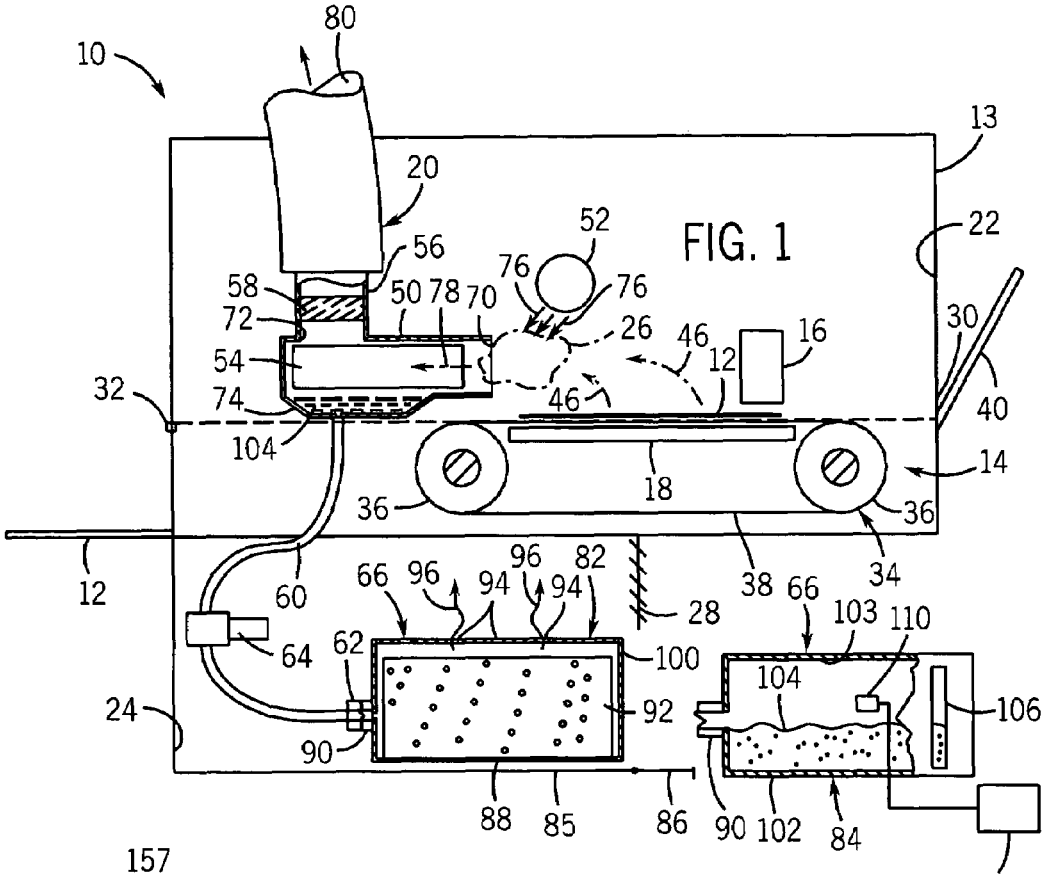
FIG. 1 is a schematic illustration of one example of a printing system of the present invention.

FIG. 1 schematically illustrates printing system 10 configured to print upon a print medium 12. Although print medium 12 is illustrated as comprising a single distinct sheet of print medium, such as paper, having a major dimension of 11 inches and a minor dimension of 8.5 inches, printing system 10 may alternatively be configured to print upon print mediums other than paper and upon print mediums in the form of differently sized sheets, envelopes, or other forms such as continuous rolls of media or stacked interconnected sheets of print media. Printing system 10 generally includes housing 13, media handling system 14, ink dispenser 16, heater 18 and vapor handling system 20.

Housing 13 comprises a structure which supports and substantially encloses the remaining elements of printing system 10. In the particular embodiment illustrated, housing 13 is sized to rest upon a standard desk, counter or table found in an office environment. In the particular embodiment illustrated, housing 13 forms a printing chamber 22 and an evaporation chamber 24. Printing chamber 22 constitutes the volume wherein ink is deposited upon print media 12 and wherein vapor, designated by reference numeral 26, is generally created. Chamber 22 prevents the escape of vapor 26 until handled or treated by handling system 20.

Chamber 24 is generally open to the ambient atmosphere to permit portions of condensate to evaporate. In the particular embodiment illustrated, housing 13 includes vent openings 28. In alternative embodiments, other forms of openings may be provided. In still other embodiments, openings 28 may be omitted wherein evaporated condensate is contained within chamber 24. In still other embodiments, housing 13 may form only a single chamber or greater than two chambers. Moreover, housing 13 may have any of a variety of different sizes, shapes and configurations.

Media handling system 14 comprises a mechanism configured to position media 12 proximate to ink dispenser 16 prior to, during and after printing upon media 12. Media handling system 14 includes an input 30, an output 32, a media transport mechanism 34, an input tray 40 and an output tray 42. Media transport mechanism 34 transports media 12 from input 30, across ink dispenser 16 to output 32. In the particular embodiment shown, media transport mechanism 34 includes a pair of rollers 36 and a continuous belt 38. At least one of rollers 36 is rotatably driven to drive belt 38. Belt 38 carries media 12 relative to ink dispenser 16. Media transport mechanism 34 may also have various configurations depending upon the configuration and size of media 12 being transported. In alternative embodiments, media transport mechanism 34 may have alternative configurations and may use other mechanisms for transferring media 12 such as toothed wheels, media contacting rollers and the like. Although media handling system 14 is illustrated as including an input tray 40, allowing a stacked set of sheets of media 12 to be fed to system 10, and output tray 42 for receiving and forming a stack of printed upon sheets of media 12, media handling system 14 may alternatively be configured for handling continuous rolls of media 12, interconnected sheets of media 12 or other forms of media.

Ink dispenser 16 comprises a device configured to dispense or apply ink to at least one surface of media 12. For purposes of the disclosure, the term "ink" means any fluid which upon being heated results in the creation of a vapor. In the particular embodiment illustrated, ink dispenser 16 comprises at least one or more inkjet printheads. In one embodiment, ink dispenser 16 is carried by a carriage (not shown) across media 12 while media 12 is transported by transport mechanism 34 perpendicular to the movement of dispenser 16. FIG. 5 of co-pending U.S. patent application Ser. No. 10/285,352 illustrates one example of a carriage movably supporting an ink dispenser. Once again, the full disclosure of this entire patent is incorporated by reference. In another embodiment, dispenser 16 extends substantially across media 12 as media 12 is moved relative to ink dispenser 16. Examples of this arrangement are commonly referred to as page-wide array printers. In alternative embodiments, other forms of ink dispensers may be employed.

Heater 18 comprises a device configured to emit heat towards media 12 at least after the ink has been deposited upon media 12. Heater 18 may comprise any one of a variety of heating devices such as an infrared heater, an induction heater, a resistive heater, a convection heater and the like. Although heater 18 is illustrated as being situated between rollers 36 below belt 38, heater 18 may alternatively be situated within rollers 36 or be arranged above media 12. As indicated by arrows 46, the heating of the ink deposited upon media 12 dries and solidifies the ink upon media 12, but also creates vapor 26. Vapor 26 is generally humid air comprising a mixture of water from the ink, paper and solvents from the ink and ink aerosol. In some applications, this vapor may be toxic. In other applications, vapor 26 may have an undesirable odor. In addition to being created upon the drying of the ink upon media 12, vapor 26 may also result during the actual process itself of depositing the ink upon media 12.

Vapor handling system 20 manages vapor 26 and generally includes condensing chamber 50, blower 52, condenser 54, exhaust duct 56, filter 58, condensate conduit 60, coupler 62, pump 64 and condensate storage system 66. Condenser chamber 50 comprises a structure formed from one or more walls configured to channel or direct vapor 26 adjacent to and along condenser 54. In the particular embodiment illustrated, chamber 50 includes an inlet 70, an outlet 72 and a condensate collection portion 74 situated below condenser 54. The exact configuration of condenser chamber 50 may vary depending upon such factors as the configuration of condenser 54, the precise process by which vapor 26 is transported through chamber 50 and the process by which condensate is handled.

Blower 52 comprises a mechanism configured to direct vapor 26 into condenser chamber 50. In the particular embodiment illustrated, blower 52 comprises a fan configured to direct air in a direction indicated by arrows 76 so as to move vapor 26 through inlet 70 and across condenser 54 as indicated by arrow 78. In alternative embodiments, blower 52 may be situated at other locations. For example, in lieu of blowing vapor 26 into inlet 70, blower 52 may alternatively be situated so as to create a vacuum within condenser chamber 50 to draw vapor 26 into condenser chamber 50. In one alternative embodiment, blower 52 may be situated within duct 56 so as to draw air through chamber 50 and through filter 58.

Condenser 54 comprises an arrangement configured to condense vapor 26 into a condensate 104. In the embodiment illustrated, condenser 54 condenses the water and solvents of vapor 26. The condensate 104 is collected in condensate collection portion 74 of condenser chamber 50. The remaining portion of vapor 26 which does not condense into a condensate is directed through output 72 of chamber 50 through filter 58 and through exhaust duct 56.

Exhaust duct 56 has an interior in communication with the interior of chamber 50 via outlet 72. Duct 56 includes an exhaust opening 80, whereby the remnants of vapor 26 are expelled. In one embodiment, the remnants of vapor 26 may be expelled to the outside air. In another embodiment, the remnants of vapor 26 may be recycled for use in other processes.

Filter 58 generally comprises one or more layers of porous material configured to permit the flow of gas, such as air, therethrough while filtering particles from vapor 26 which have not condensed, such as aerosols. The exact configuration and type of filter 58 may be varied as desired depending upon the characteristics of the gas to be filtered and the type of particles to be filtered out. Filter 58 is generally situated between condenser 54 and opening 80 of exhaust duct 56.

Conduit 60 comprises a fluid passage extending from condensate collection portion 74 of chamber 50 to condensate storage system 66. Conduit 60 generally terminates at fluid coupler 62. Fluid coupler 62 comprises a connector releasably coupled to condensate storage system 66. For purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. In the particular embodiment illustrated, coupler 62 is configured to automatically occlude or seal off conduit 60 upon being disconnected from condensate storage system 66. In one embodiment, fluid coupler 62 may comprise a one-way valve mechanism or may comprise one of septum and a needle. In alternative embodiments, fluid coupler 62 may be omitted or fluid coupler 62 may be configured so as to not necessarily occlude or seal off conduit 60 in a disconnected state.

Pump 64 is situated along conduit 60 which comprises a mechanism configured to pump condensate from collection portion 74 through conduit 60 into storage system 66. In particular applications, pump 64 may also be configured to seal or occlude conduit 60 in a non-pumping state. In such an embodiment, fluid coupler 62 may alternatively be configured so as to not necessarily automatically occlude conduit 60 when in a disconnected state. Pump 64 may be configured to pump condensate in response to manual input from an individual or automatically in response to control signals generated by a controller which generates such signals periodically or in response to signals from a sensor configured to sense the level of condensate within collection portion 74.

In lieu of conduit 60 transmitting condensate from collection portion 74 to storage system 66, storage system 66 may be omitted and conduit 60 may alternatively transmit condensate to a drain. In other embodiments, pump 64 may be omitted, wherein wicking action or gravity may be utilized to withdraw condensate from collection portion 74. In still other embodiments, storage system 66 may alternatively be provided as part of collection portion 74 and chamber 50.

Condensate storage system 66 includes interchangeable storage subsystems 82, 84, which are each configured to temporarily store condensate for disposal or recycling. Because systems 82 and 84 are interchangeable, a long delay of printing by system 10 is not required when one of subsystems 82 can no longer store any additional condensate. As shown by FIG. 1, subsystems 82 and 84 are each removably receivable within housing 13 and removably connected to coupler 62. In the embodiment shown, housing 13 forms a bay 85 which receives either of storage subsystems 82 and 84. In alternative embodiments, housing 13 may include a pair of bays for receiving both of subsystems 82 and 84, wherein condensate from chamber 50 may be selectively directed to one of subsystems 82 and 84 by means of a switch connected to a valving mechanism. In the embodiment shown, bay 85 is closed by a hinged door 86. In alternative embodiments, door 86 may slide between an open and closed position or door 86 may be omitted where a portion of subsystem 82 or 84 forms part of the exterior of system 10.

When one of subsystems 82 and 84 is sufficiently filled with condensate, the filled storage subsystem is removed from system 10 and is shipped to a collection entity for recycling or disposal of the stored condensate. Alternatively, the filled storage subsystem may be disposed of. When the filled storage subsystem 82, 84 is removed, the other of subsystems 82, 84 is inserted in its place.

Storage subsystem 82 generally includes receptacle 88, fluid coupler 90 and absorption member 92. Receptacle 88 generally comprises a container configured to receive and store condensate. Receptacle 88 includes at least one wall having perforations 94 comprised to permit air flow such that portions of the condensate, such as water, within receptacle 88 to evaporate as indicated by arrows 96. Receptacle 88 further includes a removable or separable portion 100 (shown as a lid) providing access to an interior of receptacle 88 for removal or replacement of absorption member 92.

Fluid coupler 90 comprises a coupling device configured to fluidly connect conduit 60 to the interior of receptacle 88. In the particular embodiment illustrated, fluid coupler 90 has a closing portion configured to automatically occlude or seal off the interior of receptacle 88 in response to being disconnected from fluid coupler 62. In one embodiment, coupler 90 may comprise one of a septum or a needle. In another embodiment, coupler 90 may include any one of a variety of alternative valving mechanisms. In one embodiment, fluid coupler 90 is also configured to actuate or move to an open state and connected to an alternative discharging fluid coupler such as when receptacle 88 is being emptied of its condensate for disposal or recycling.

Condensate absorbing member 92 comprises a member positioned within receptacle 88 and configured to absorb the liquid condensate. In one embodiment, condensate absorbing member 92 comprises a foam. In one embodiment, member 92 is releasably or removably positioned within receptacle 88 such that member 92 may be withdrawn from receptacle 88 when portion 100 is removed or separated, enabling member 92 to be disposed or and replaced with an empty member 92 or enabling member 92 to be emptied of its condensate. In the embodiment in which receptacle 88 includes perforations 94, member 92 permits portions of the condensate absorbed into member 92 to be evaporated.

Condensate storage subsystem 84 is similar to condensate storage subsystem 82 except that condensate storage subsystem 84 includes receptacle 102 in lieu of receptacle 88 and omits condensate absorbing member 92. Those elements of subsystem 84 which correspond to portions of subsystem 82 are numbered similarly. Receptacle 102 is similar to receptacle 88 except that receptacle 102 forms a substantially sealed interior 103 for containing the condensate 104. Such condensate within interior 103 may be expelled through fluid coupler 90 and an appropriately configured opposite coupler. In alternative embodiments, receptacle 102 may be provided with an opening sealed with a cap or other sealing member.

Receptacle 102 additionally includes a fill indicator 106 configured to indicate a volume of the receptacle that is filled with condensate 104. Fill indicator 106 indicates when condensate storage subsystem 66 must be replaced. In the particular embodiment illustrated, indicator 106 comprises a transparent or semi-transparent window enabling a viewer to identify the extent to which interior 103 is filled with condensate 104. In alternative embodiments, fill indicator 106 may comprise a sensor 110 within interior 103 connected to an electronic display 112. Sensor 110 comprises any one of a variety of known sensors configured to sense the level of fluid within a volume. For example, sensor 110 may comprise a sensor including a float or a sensor which requires the presence of fluid between two contacts to complete an electrical circuit. Display 112 may comprise an analog or digital display configured to indicate the extent to which interior 103 is filled with condensate 104. Display 112 may be located on the exterior of receptacle 102 or may be provided as part of another surface of system 10, wherein the connection of coupler 90 to coupler 62 also results in connection of sensor 110 to display 112.

Although condensate storage system 66 is illustrated as including two distinct subsystems 82 and 84, system 66 may alternatively include one or more subsystems that are identical to one another. Although subsystems 82 and 84 are illustrated as being movably positioned within housing 13 and coupled to the remainder of system 10, condensate storage system 66 may alternatively include a receptacle that is permanently coupled to housing 13 as part of system 10, wherein the receptacle is provided with a sufficient volume to contain the expected amount of condensate produced during the life of system 10. In other embodiments, condensate storage system 66 may be replaced with condensate storage system described in co-pending U.S. patent application Ser. No. 10/285,352, incorporated into this application by reference. In still other embodiments, condensate storage system 66 may be omitted, wherein condensate is simply directed to a drain or other disposal outlet.

Overall, printing system 10 facilitates high-speed printing by heating the ink deposited upon media 12 to dry and solidify the ink. At the same time, vapor handling system 20 effectively manages the resulting vapor. By condensing the vapor, system 20 reduces the volume of high humidity air that is exhausted to the atmosphere. In addition, condensate storage system 66 enables the resulting condensate to be appropriately disposed of in an efficient manner. In particular, subsystem 82 enables the water portion of the condensate to evaporate over time, reducing the amount of waste that must be handled, while retaining odorous or toxic portions on the condensate. Condensate absorbing member 92 absorbs the condensate facilitating quick removal and disposal of the condensate. Because subsystem 82 or subsystem 84 are removably coupled to the remainder of vapor handling system 20, subsystem 82 or subsystem 84 may be quickly and easily replaced once their capacity for holding condensate has been sufficiently diminished. In addition, full or substantially full receptacles 88 or 102 may then be disposed of or emptied by a system user or at a designated collection center capable of appropriately handling the elements possibly contained within the condensate.

Figure 2:
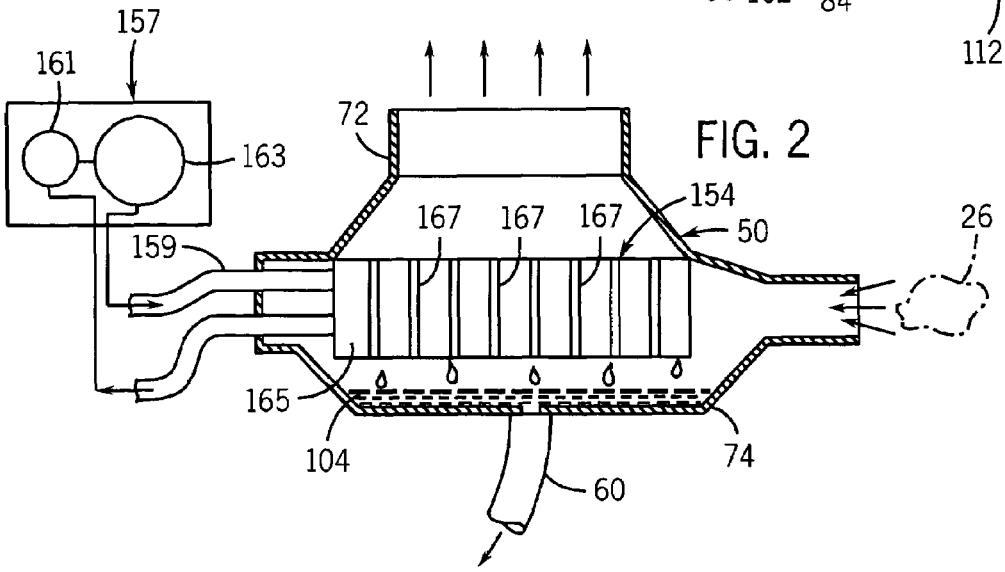
FIG. 2 is a schematic illustration of a specific embodiment of a vapor handling system of the printing system of FIG. 1, portions of the vapor handling system being omitted for ease of discussion.
Figure 1:
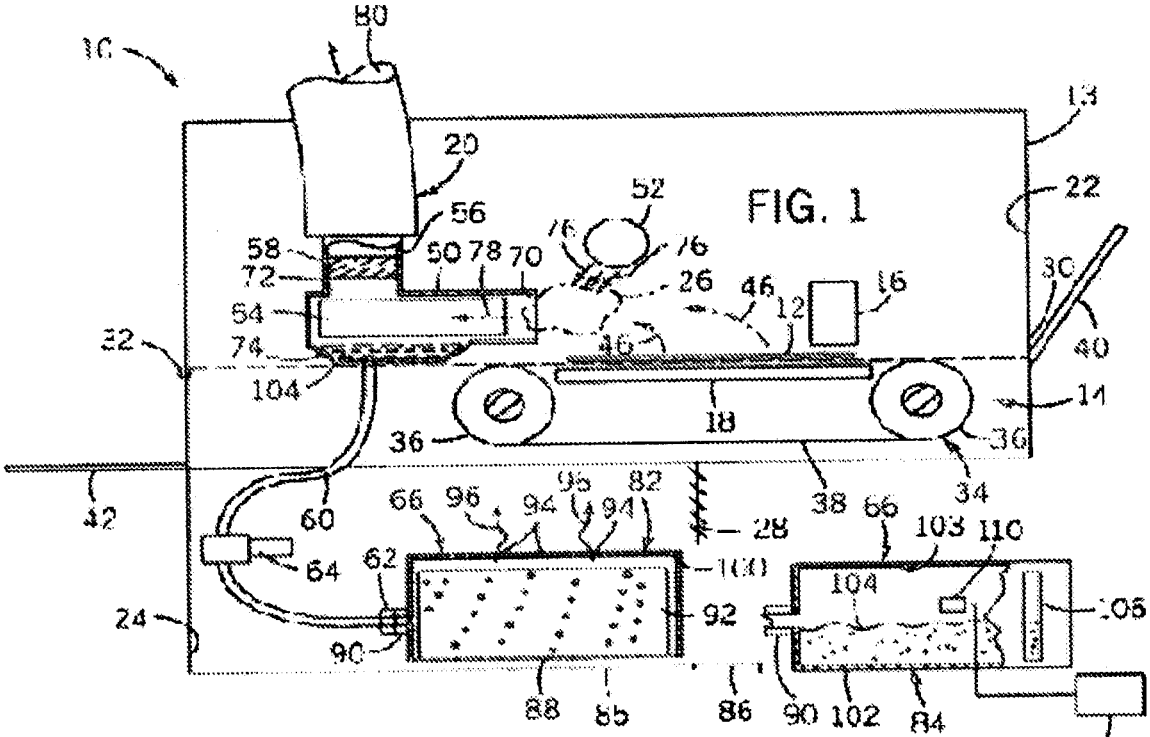
Figure 2:
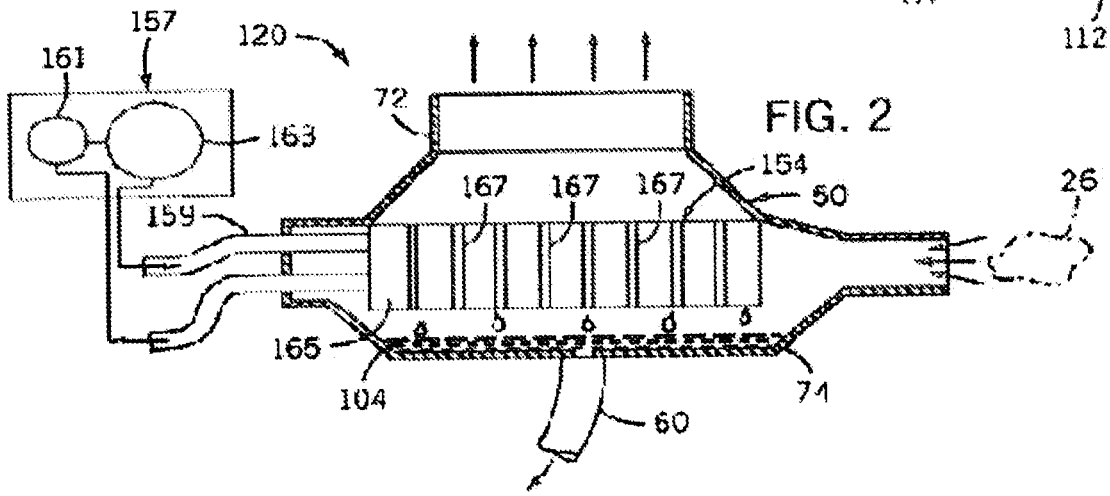

FIG. 2 schematically illustrates vapor handling system 120, one embodiment of vapor handling system 20 described and shown with respect to FIG. 1. Vapor handling system 120 is similar to vapor handling system 20 except that vapor handling system 120 specifically includes condenser 154, a specific embodiment of condenser 54. The remaining elements of vapor handling system 120 are identical to vapor handling system 20 and are either not shown or are numbered similarly for ease of discussion. Condenser 154 condenses vapor 26 into condensate 104. Condenser 154 includes coolant source 157 and conduit 159. Coolant source 157 comprises a device configured to supply a coolant. The coolant produced by source 157 is circulated through the interior of condenser chamber 50. The coolant is preferably at a temperature so as to condense vapor 26 along conduit 159 within chamber 50. In one embodiment, source 157 supplies a fluid coolant utilizing a pump 161 and a compressor 163. In alternative embodiments, other devices may be utilized to supply a coolant.

Conduit 159 comprises a structure configured to direct coolant provided by source 157 through and within condensing chamber 50. Conduit 159 has an interior through which the coolant circulates. Portions of conduit 159 adjacent the interior of conduit 159 are formed from highly thermally conductive materials such as copper, aluminum, copper alloys or aluminum alloys. These highly conductive materials form a condensing surface 165 upon which vapor 26 condenses into condensate 104. In the particular embodiment illustrated, condenser 154 additionally includes a plurality of fins 167 thermally coupled to conduit 159. The term "thermally coupled" means two elements are positioned relative to one another such that heat is transferred between such elements. Such elements may be in direct contact with one another, spaced from one another but sufficiently close such that heat is transferred through gas or air between such elements, or may be positioned with intermediate structures or materials that have relatively high thermal conductivities such as thermally conductive epoxies, paste or thermally conductive metals such as aluminum, aluminum alloys, copper or copper alloys. Such fins 167 are formed from a highly thermally conductive material such as aluminum, copper, aluminum alloys or copper alloys. In one embodiment, fins 167 have interiors (not shown) in fluid communication with the interior of conduit 159 such that the coolant flows through and within fins 167. In alternative embodiments, the coolant does not flow through or within fins 167. Fins 167 provide condenser 154 with an enlarged surface area upon which vapor 26 may be condensed to enhance the rate at which vapor 26 is condensed.

FIGS. 3 and 4 illustrate vapor handling system 220, a specific embodiment of vapor handling system 20 shown and discussed with respect to FIG. 1. System 220 is similar to system 20 except that system 220 includes condensing chamber 250 and condenser 254 in lieu of chamber 50 and condenser 54. Those remaining elements of handling system 220 are identical to the corresponding elements of handling system 20 and are either not shown or are numbered similarly for ease of discussion. Chamber 250 is similar to chamber 50 in that it directs vapor 26 to and across at least a portion of condenser 254 prior to vapor 26 being exhausted through filter 58 and out duct 56. Chamber 250 has an inlet 270 and an outlet 72. Inlet 270 is configured to extend in close proximity to and along a surface of print medium 12. As a result, a stronger vacuum is created along the surface of medium 12 to better facilitate the withdrawal of vapor 26 along the surface of medium 12. In the particular embodiment illustrated in FIGS. 3 and 4, a fan or blower (not shown) is disposed between opening 80 and filter 58 to draw vapor 26 through filter 58. Although not shown, chamber 250 includes a depressed portion below condenser 254 where produced condensate collects, under the force of gravity, for removal through conduit 60 (shown in FIG. 1).

Condenser 254 condenses vapor 26 within chamber 50 so as to convert vapor 26 into a condensate. Condenser 254 generally includes thermoelectric module 257, cooling member 259, heat absorption member 261 and fan 263. Thermoelectric module 257 comprises a thermoelectric module which utilizes the Peltier effect to absorb heat from cooling member 259 to cool cooling member 259 and to release heat to absorption member 261. With module 257, an electrical current is passed through a circuit of two dissimilar conductors. Depending on the current direction, the junction of the two conductors will either absorb or release heat. The amount of heat pumped is in direct proportion to the current supplied. As a result, module 257 cools cooling member 259 without moving parts, without fluid and without a compressor, increasing the compactness and reducing the cost of condenser 254. The amount of cooling may be precisely controlled by varying or altering the amount of power supplied to module 257.

Cooling member 259 comprises a member having one or more condensing surfaces 265 along which vapor 26 condenses. Member 259 is disposed within chamber 250 such that vapor 26 is drawn through member 259. In the particular embodiment illustrated, member 259 includes a plurality of fins 267 which direct air flow towards outlet 72 and chamber 50. Fins 267 provide member 259 with an enlarged surface area to better facilitate the rate at which vapor 26 is condensed. Cooling member 259 is thermally coupled to module 257 and is formed from a highly thermally conductive material such as aluminum, aluminum alloy, copper or copper alloy.

Heat absorption member 261 comprises a heat sink configured to absorb heat pumped from cooling member 259 and released by module 257. Member 261 is formed from a highly thermally conductive material such as aluminum, aluminum alloys, copper or copper alloys. In the particular embodiments shown, member 261 includes a plurality of fins 269 to facilitate the dissipation of heat. Fan 263 is positioned proximate to member 261, and increases the rate at which heat is dissipated from member 261 by drawing air through member 261 as indicated by arrows 271. In alternative embodiments, fan 263 may be omitted.

Vapor handling systems 120 and 220 illustrate two examples of condenser arrangements that may be employed in system 10. In alternative embodiments, other condenser arrangements may be employed. Regardless of the arrangement chosen, vapor handling systems 20, 120 and 220 efficiently manage vapor produced during printing upon medium 12.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printing system comprising:

an ink dispenser configured to deposit ink upon a print medium; and a condenser configured to condense vapor into a condensate;

a receptacle configured to collect the condensate, wherein the receptacle is perforated to permit a portion of the condensate to evaporate, wherein the receptacle is removably coupled to a remainder of the system and wherein the receptacle includes:

an inlet through which the condensate flows into the receptacle; and a closing portion movable between an inlet open position and an inlet closing position.

2. The system of claim 1, wherein the condenser includes:

a conduit having a conduit interior; and a coolant source connected to the conduit and configured to supply coolant into the conduit interior at a temperature so as to condense the vapor along the conduit.

3. The system of claim 2, wherein the coolant source is configured to supply a liquid at a temperature so as to condense the vapor along the conduit.

4. The system of claim 2, wherein the coolant source is configured to supply a gas at a temperature so as to condense the vapor along the conduit.

5. The system of claim 2, wherein the condenser includes a fin thermally coupled to the conduit.

6. The system of claim 2, wherein the coolant source includes:

a pump configured to move fluid; and a cooling device configured to cool the fluid to the temperature.

7. The system of claim 6, wherein the cooling device includes a compressor.

8. The system of claim 1, further comprising means for automatically moving the closing portion to the inlet closing position when the receptacle is disconnected from the remainder of the printing system.

9. The system of claim 1, wherein the condenser includes a thermoelectric module.

10. The system of claim 9, wherein the condenser includes a plurality of fins thermally coupled to the thermoelectric module.

11. The system of claim 10 wherein the plurality of fins converge from an inlet side proximate the ink dispenser and have a first dimension to an outlet side distant the ink dispenser and having a second smaller dimension.

12. The system of claim 1 including a blower configured to move the vapor along the condenser.

13. The system of claim 12 including:

a duct proximate the condenser and having an exhaust opening; and a filter between the condenser and the exhaust opening.

14. The system of claim 1, wherein the receptacle includes a condensate-absorbing material within the receptacle.

15. The system of claim 14, wherein the condensate-absorbing material is removable from the receptacle.

16. The system of claim 14, wherein the condensate-absorbing material comprises a foam.

17. The system of claim 1, wherein the receptacle includes a fill indicator configured to indicate a volume of the receptacle that is filled with condensate.

18. The system of claim 1, wherein the ink dispenser includes an inkjet printhead.

19. The system of claim 1 including a media handling system configured to transport individual sheets of material relative to the ink dispenser.

20. The system of claim 19, wherein the media handling system is configured to handle sheets of material having a minor dimension less than 9 inches.

21. The system of claim 19, wherein the media handling system is configured to stack the individual printed upon sheets.

22. The system of claim 1 including a heater configured to heat the deposited ink, whereby vapor is produced.

23. The system of claim 1, wherein the condenser includes a plurality of fins converging from an inlet side proximate the ink dispenser and having a first dimension to an outlet side distant the ink dispenser and having a second smaller dimension.

24. The system of claim 1 further comprising one or more conduits configured to direct all of the condensate from the condenser to the receptacle.

25. A printing system comprising:

means for depositing ink upon a print medium;

means for condensing vapor to form a condensate; and means for storing the condensate, wherein the means for storing includes an inlet and means for automatically occluding the inlet when disconnected from a remainder of the printing system.

26. The system of claim 25 including means for storing includes means for evaporating a portion of the condensate while the condensate is being stored.

27. The system of claim 25 including means for heating the deposited ink, whereby vapor is formed.

28. A method of printing ink upon a medium, the method comprising:

depositing ink upon the medium;

heating the deposited ink to create a vapor;

condensing the vapor into a condensate;

collecting the condensate in a first receptacle; and absorbing at least a portion of the condensate into a first absorption member within the first receptacle.

29. The method of claim 28 including circulating a fluid through a thermally conductive conduit having a condensing surface to cool the condensing surface to a temperature to condense the vapor.

30. The method of claim 28 including powering a thermoelectric module having a cool portion and a hot portion, wherein the cool portion is thermally coupled to a condensing surface along which the vapor is condensed.

31. The method of claim 28 including evaporating a portion of the condensate within the first receptacle.

32. The method of claim 28 including replacing the first absorption member with a second absorption member.

33. The method of claim 28 including replacing the first receptacle with a second receptacle when at least a portion of the first receptacle is filled with condensate.

34. The method of claim 28 including sending the first receptacle at least partially filled with the condensate to a collection entity for recycling or disposal of the condensate.

35. The method of claim 28 including sensing an amount of condensate within the first receptacle.

36. The method of claim 28 including directing the vapor across a condensing surface and through a filter.

37. The method of claim 28, wherein the step of depositing ink includes ejecting ink from an inkjet printhead upon the medium.

* * * * *

UNITED STATES PATENT AND TRADEMARK OFFICE

CERTIFICATE OF CORRECTION

PATENT NO. : 7,665,824 B2
APPLICATION NO. : 10/698511
DATED : February 23, 2010
INVENTOR(S) : Michel A. Riou et al.

It is certified that error appears in the above-identified patent and that said Letters Patent is hereby corrected as shown below:

The Title Page, showing an illustrative figure, should be deleted and substitute therefor the attached title page.

On Sheet 1 of 2, in Figure 1, delete "12" and insert -- 42 --, therefor.
Replacement Sheet is attached herewith.

On Sheet 1 of 2, in Figure 2, add element number " 120 " above element number "163".
Replacement Sheet is attached herewith.

Signed and Sealed this

Sixth Day of July, 2010

David J. Kappos

David J. Kappos
*Director of the United States Patent and Trademark Office*

(12) United States Patent
Riou et al.

(10) Patent No.: US 7,665,824 B2
(45) Date of Patent: Feb. 23, 2010

(54) PRINTING SYSTEM CONDENSER

(75) Inventors: Michel A. Riou, Calgary (CA); David B. Larson, Eagle, ID (US); Martin G. Rockwell, Sherwood, OR (US); David R. Christmann, Boring, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1120 days.

(21) Appl. No.: 10/698,511

(22) Filed: Oct. 31, 2003

(65) Prior Publication Data

US 2005/0093908 A1 May 5, 2005

(51) Int. Cl.
*B41J 2/165* (2006.01)

(52) U.S. Cl. ..... 347/34; 347/36

(58) Field of Classification Search ..... 347/34
See application file for complete search history.

(56) References Cited

U.S. PATENT DOCUMENTS 3,848,988 A * 11/1974 Thettu et al. ..... 399/97
3,854,224 A * 12/1974 Yamaji et al. ..... 34/77
4,004,513 A * 1/1977 Watanabe et al. ..... 101/489
4,524,365 A * 6/1985 Kakeno et al. ..... 347/86
4,556,487 A * 12/1985 Ueda ..... 210/267
4,914,453 A * 4/1990 Kanayama et al. ..... 347/86
4,919,301 A * 4/1990 Miller ..... 137/581
4,958,681 A * 9/1990 Kadle ..... 165/151
5,073,796 A * 12/1991 Suzuki et al. ..... 399/93
5,280,709 A * 1/1994 Wang ..... 62/617
5,335,000 A 8/1994 Stevens
5,446,487 A * 8/1995 Russell et al. ..... 347/102
5,532,720 A * 7/1996 Krueger et al. ..... 347/85
5,771,053 A * 6/1998 Merrill ..... 347/86
6,025,860 A * 2/2000 Rosenfeld et al. ..... 347/171
6,076,913 A * 6/2000 Garcia et al. ..... 347/19
6,085,055 A * 7/2000 Shin et al. ..... 399/250
6,088,560 A * 7/2000 Zenk et al. ..... 399/237
6,101,356 A * 8/2000 Kim et al. ..... 399/250
6,174,055 B1 * 1/2001 Sugikubo et al. ..... 347/89
6,176,563 B1 * 1/2001 Anderson et al. ..... 347/22
6,203,138 B1 * 3/2001 Hirabayashi et al. ..... 347/36
6,281,911 B1 * 8/2001 Nakazawa et al. ..... 347/86
6,352,324 B1 * 3/2002 Pagnon et al. ..... 347/6
6,357,854 B1 * 3/2002 Igval et al. ..... 347/36
6,397,488 B1 * 6/2002 Brinkly ..... 34/92
6,512,900 B2 * 1/2003 Sakai ..... 399/93
6,536,863 B1 * 3/2003 Beauchamp et al. ..... 347/17
6,553,689 B2 * 4/2003 Jain et al. ..... 34/444
6,659,587 B2 * 12/2003 Berg et al. ..... 347/36
6,771,916 B2 * 8/2004 Hoffman et al. ..... 399/92
6,854,843 B2 * 2/2005 Anami et al. ..... 347/104
6,874,877 B2 * 4/2005 Gaston et al. ..... 347/86
6,908,179 B2 * 6/2005 Pan et al. ..... 347/86

(Continued)

FOREIGN PATENT DOCUMENTS

EP 0816097 7/1998

(Continued)

*Primary Examiner*—Matthew Luu
*Assistant Examiner*—Shelby Fidler

(57) ABSTRACT

A printing system includes an ink dispenser configured to dispense ink upon a print medium, a condenser configured to condense vapor into a condensate and a receptacle configured to collect the condensate. The receptacle is perforated to permit a portion of the condensate to evaporate.

37 Claims, 2 Drawing Sheets

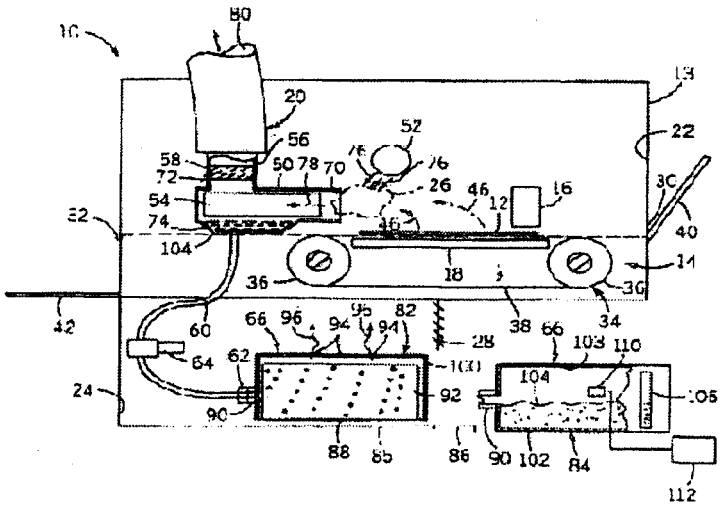

10
80
20
56
58
72
54
74
104
32
42
24
52
50
78
70
76
26
46
12
16
22
30
40
14
18
36
34
38
60
64
62
90
66
96
94
95
82
28
100
92
88
85
86
103
110
105
102
84
112

157
161
163
120
72
159
167
154
50
26
165
104
74
60